United States Patent [19]

Damour

[11] 4,124,173

[45] * Nov. 7, 1978

[54] EXPANDING OUTER SLEEVE FOR A MANDREL OR CHUCK

[76] Inventor: Lawrence R. Damour, 16 Chesler Sq., Succasunna, N.J. 07876

[ * ] Notice: The portion of the term of this patent subsequent to Nov. 4, 1992, has been disclaimed.

[21] Appl. No.: 758,471

[22] Filed: Jan. 11, 1977

[51] Int. Cl.[2] ..... B65H 75/18

[52] U.S. Cl. ..... 242/72 B

[58] Field of Search ..... 242/72 R, 72 B, 72.1; 279/2 R, 2 A; 82/44; 269/48.1

[56] References Cited

U.S. PATENT DOCUMENTS

| | | | |
|---|---|---|---|
| 2,145,806 | 1/1939 | Schnedarek | 242/72 B X |
| 3,025,072 | 3/1962 | Cahill | 242/72 B X |
| 3,552,673 | 1/1971 | Evers | 242/72.1 |
| 3,823,892 | 7/1974 | Glaser | 242/72 B X |
| 3,878,999 | 4/1975 | Daves | 242/72 R X |
| 3,917,187 | 11/1975 | Damour | 242/72 B |
| 3,937,412 | 2/1976 | Damour | 242/72 B |

*Primary Examiner*—Harvey C. Hornsby
*Assistant Examiner*—John M. Jillions
*Attorney, Agent, or Firm*—Ralph R. Roberts

[57] ABSTRACT

This invention pertains to an expanding mandrel or chuck in which air or hydraulic fluid is fed to and into a resilient tube arranged either in a helical or longitudinal manner. This application particularly pertains to an expanding outer sleeve as shown in my U.S. Pat. No. 3,937,412 as issued on Feb. 10, 1976 which is an improvement upon my U.S. Pat. No. 3,917,187 as issued on Nov. 4, 1975. In the improved leaf construction of this application a plurality of leaf-like members is linked so as to be maintained in a complete circle without displacement therefrom or expansion beyond a determined limit. Each leaf-like member has one longitudinal edge formed with a keyhole-type groove and the other edge formed with the tongue member having an enlarged outer portion which slidably fits into this groove. In an assembled condition the tongue member of one leaf is mounted in the keyhole groove of the next adjacent leaf. This keyhole-type groove arrangement and mating tongue provide a safety means to the expansion. In order to retain and move these leaf members in their desired inner limit circumferential grooves are cut into the outer surface of these leaf members after they have been assembled. Garter springs or rubber O-rings are mounted in these grooves to urge the leaf members into the inner condition. The expanding tube may be protected by a rubber strip or channel which fits into the groove and prevents tube contact with the leaf-like members.

15 Claims, 14 Drawing Figures

PRIOR ART U.S. PAT. 3,937,412

PRIOR ART U.S. PAT. 3,917,187

EXPANDING OUTER SLEEVE FOR A MANDREL OR CHUCK

CROSS REFERENCE TO RELATED PATENTS

To the extent applicable to the present invention, reference is made to my U.S. Pat. No. 3,917,187 as issued on Nov. 4th, 1975 and based upon Application Ser. No. 488,160, filed July 12th, 1974 and entitled, "Expanding Mandrel or Chuck" and also to my U.S. Pat. No. 3,937,412 as issued on Feb. 10th, 1976 and based upon Application Ser. No. 570,762, filed Apr. 3rd, 1975 and entitled, "Expanding Outer Sleeve for a Mandrel or Chuck".

BACKGROUND OF THE INVENTION

1. Field of the Invention

With reference to the classification of art as established in the United States Patent and Trademark Office this invention pertains to the general Class entitled, "Winding and Reeling" (Class 242) and more particularly to the subclass entitled, "contractible or expansible — with inflatable means" (subclass 72B).

2. Description of the Prior Art

Expanding chucks and mandrels are well known in the art and in particular expanding mandrels or chucks which use hydraulic fluid or air to expand and move the segments.

In particular, such devices are particularly shown in my U.S. Pat. No. 3,917,187 as issued on Nov. 4th, 1975 and in my U.S. Pat. No. 3,937,412 as issued on Feb. 10th, 1976. In both my above-identified patents the retention and expansion of the leaf members have been limited as to their expansion by means of interrelated shoulder members or in tongue and groove members. In the expanding mandrels, above-described, tension retention of the leaf members either by a garter spring or a rubber strip which engages and is mounted in grooves in the leaf members is shown. These rubber strip members are fitted to the inside grooves of the longitudinal leaf members to retain these members in the inner condition. It has been found that in the smaller expanding chucks that where the length is rather extensive the sliding in place of the last rubber strip into the grooves of the adjacent leaf member has been a problem. In the present invention the interlocked longitudinal segments used are of like metal extrusion. These extrusions are leaf members cut to length from a long extrusion length. Each leaf segment has one longitudinal edge formed as a tongue with an enlarged rounded end and the other edge is formed with an arcuate T-groove. The undersurface portion of each longitudinal segment, instead of being provided with longitudinal grooves, is smoothly finished with no provision for mounting rubber strips in grooves formed in the leaves comprising the expanding outer portion of the mandrel. After assembling, the present invention contemplates chafe-preventing strips. In the present invention the means for moving the several leaf members to their inner extent or limit are circumferential grooves that are formed in the exterior of the assembled mandrel. These circumferential grooves are formed by clamping the leaf assembly and in a lathe cutting these grooves. In these grooves are fitted garter springs or rubber O-rings, as selected.

SUMMARY OF THE INVENTION

This invention may be summarized at least in part with reference to its objects.

It is an object of this invention to provide, and it does provide, and outer drive sleeve for expanding mandrels or chucks which by increasing or decreasing the multiplicity of outer leaf members provides an assembly which accommodates a given range of sizes. Each like leaf has a tongue member formed on one edge of the leaf and a mating receiving groove along the other edge of the leaf. The underside of each leaf member is smooth and a tension means for drawing the leaf members to and toward the body of the mandrel is provided by garter springs or rubber O-rings which are fitted into grooves cut into the exterior of the leaf members at the time of assembly. The torque transmitted to and from the outer expanded sleeve is transmitted to the body of the mandrel through one or more pins or screws passing through the leaf members and into the body.

It is a further object of this invention to provide, and it does provide, an outer drive sleeve for an expanding mandrel or chuck in which a plurality of like leaf members is serially connected at its edges in a tongue and groove arrangement. A small amount of play is provided in this joining means for expansion. The like leaf segments are preferably formed so that their connected pitch length is either one-sixteenth, one-eighth or one-quarter of pi times 1 inch. All leaf members of this sleeve are expanded to engage and support the core or spool being driven. The expanded sleeve provides the complete peripheral drive and support surface.

In brief, the expanding mandrel or chuck includes an outer drive sleeve composed of a plurality of like leaf segments. These leaf segments are preferably extruded metal members cut to a desired length. The pitch length of the segments are preferably made as a fraction of pi times 1 inch, i.e., one sixteenth, one-eighth or one-quarter pi times 1 inch. A tongue member is formed along one edge. This tongue member has an enlarged outer end of circular cross section. The other edge of said leaf members has a retaining groove with its inner portion enlarged to receive and slidably retain the enlarged circular edge portion of the tongue member of a connected adjacent leaf. Each leaf is smooth on its undersurface and outer surface circumferential grooves are formed in the outer surface of the assembled mandrel. Into these grooves are mounted tensioned members in the form of garter springs or rubber O-rings which are sufficiently tensioned to draw the leaf members into this inner position against the body.

In addition to the above summary the following disclosure is detailed to insure adequacy and aid in understanding of the invention. This disclosure, however, is not intended to cover each new inventive concept therein no matter how it may later be disguised by variations in form or additions of further improvements. For this reason there has been chosen a specific embodiment of the expanding outer drive sleeve employing like leaf segments serially connected with tongue and groove edges and having circumferential grooves formed therein. These leaf segments are drawn together by means of garter springs, expanded O-rings and the like which are fitted into circumferential grooves cut into exterior surfaces of the leaf members at the time of their assembly and prior to their use.

This specific embodiment has been chosen for the purpose of illustration and description as shown in the accompanying drawing wherein:

Figure 1:
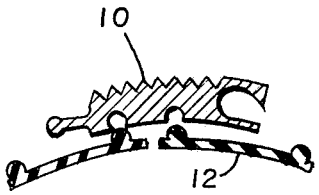
FIGS. 1 and 2 represent a cross section of the prior art as is seen in U.S. Pat. No. 3,937,412.

To the extent applicable the present invention incorporates by reference the disclosure of U.S. Pat. No. 3,917,187 as issued on Nov. 4, 1975 and U.S. Pat. No. 3,937,412 as issued on Feb. 10, 1976.

In the following description and in the claims details are identified by specific names for convenience. These names, however, are intended to be generic in their application. Corresponding reference characters refer to like members throughout the fourteen figures of the drawings.

The drawings accompanying this specification disclose certain details of construction for the purpose of explanation but it is understood that they may be modified and that the expanding outer sleeve may be incorporated in other forms than shown.

DESCRIPTION OF THE PRIOR ART DEVICE OF FIGS 1 AND 2

Figure 2:
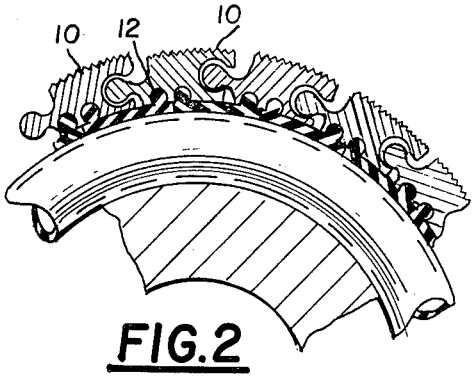

As disclosed in the prior embodiment shown in U.S. Pat. No. 3,937,412, the expanding sleeve of this invention uses interconnecting leaf segments 10 similar to those shown in FIGS. 1 and 2. As in the patent above-noted, leaf segments are made as fractional increments of pi so that by using a multiplicity of segments of like size an established size range is provided. In the reference U.S. Pat. No. 3,937,412 and as shown in the embodiment of FIGS. 1 and 2, a rubber tension member 12 is employed to draw the adjacent segments 10 together. As the tolerance allowable in these rubber segments are quite limited or severe, the extruding to preserve these tolerances is very difficult and expensive. It has been found desirable particularly in the smaller sizes of one-sixteenth and one-eighth pi to not use these rubber members 12. An alternate construction which is much simpler to make and repair is shown in FIGS. 4, 5, 6 and 7, to be hereinafter more fully discussed.

DESCRIPTION OF THE PRIOR ART OF FIGS. 3 AND 4

Figure 3:
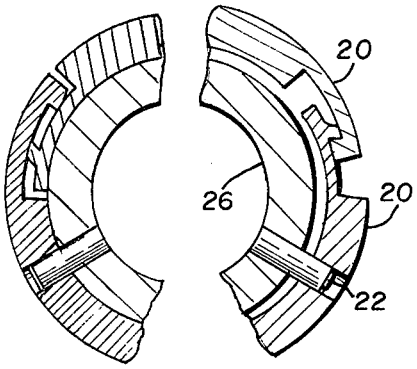
FIGS. 3 and 4 represent a cross section and a portion of the side view of the representation of the prior art as seen in U.S. Pat. No. 3,917,187.
Figure 4:
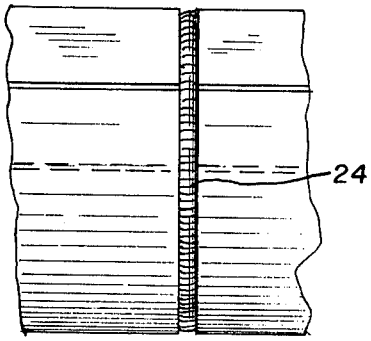

As shown in FIGS. 3 and 4, the leaf segments described are those in U.S. Pat. No. 3,917,187 issued on Nov. 4th, 1975 to the present Applicant. As shown in the expanding mandrel of that patent the leaf members or segments are not interconnected but are limited in their outward expansion by ears and grooves formed in and on the ends of the like segments. In that embodiment each segment 20 is required to be held by a pin or screw 22 and is expanded only directly outward. The means for bringing the segments to their inner condition on this spool in the embodiment of U.S. Pat. No. 3,917,817 incorporates and utilizes garter springs or O-rings 24 which retain the leaf segments 20 from falling outwardly away from the body 26.

In the present embodiment the leaf segments incorporate the tongue and groove of U.S. Pat. No. 3,937,412 with the circumferential groove and garter shown in U.S. Pat. No. 3,917,817. This is particularly seen in FIGS. 5, 6 and 7, as hereinafter to be more fully described.

DESCRIPTION OF THE IMPROVEMENT OF FIGS. 5, 6 AND 7

Figure 5:
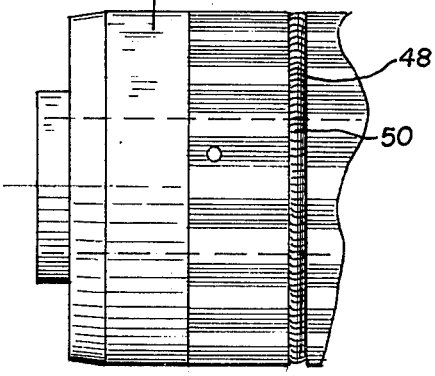
FIG. 5 represents a side view, partly fragmentary of the assembly of the leaf segments of this invention and the positioning and retaining of the segments by means of a garter spring mounted in a circumferential exterior groove.
Figure 6:
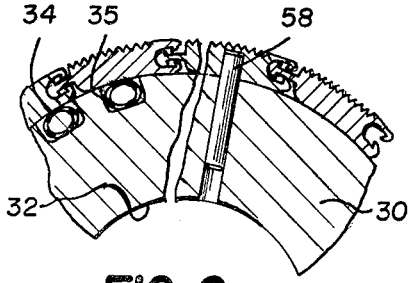
FIG. 6 represents a sectional view showing the arrangement of the segments as retained by a core and by a drive pin.
Figure 7:
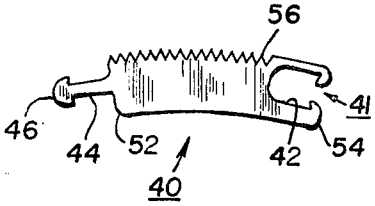
FIG. 7 represents a sectional view of a typical segment as utilized in the present invention.

Referring now to the drawings and in particular to FIGS. 5, 6 and 7, there is shown a body member 30 having a through supporting bore 32 which is sized for mounting upon a shaft, not shown. This body 30 is depicted in FIGS. 5 and 6 and may have helical grooves as in the above-identified patents or longitudinal grooves in which is mounted an expanding tube 34. Whether longitudinal or helical grooves are utilized there is provided a supporting wall 25 between the grooves and in which is mounted a rubber expanding tube 34. The body 30 has an enlarged end portion 36 at the left end and a like enlarged portion at the other end, not shown. The expanding outer sleeve of the expanding mandrel extends between these end portions and includes a series of like leaf members 40. These leaf members have an edge formed with a retaining groove 41 having an enlarged arcuate undercut 42 which is reduced as it opens to the right side. The other edge of the leaf 40 is formed with an extending tongue 44. The tongue has an enlarged outer edge 46 which is substantially circular in cross section and in an assembled condition the tongue 44 of one leaf is mounted in the groove 41 of the next adjacent leaf. The underside of the leaf member 40 is made smooth and rests upon the ribs and the expanded rubber, tubular member 34 by which the leaf members are moved outwardly.

In the present instance, rather than the rubber tension member 12 of FIG. 1 used to urge the leaf segments to the inner extent, exterior tension members are employed. The required amount of leaves are assembled together and placed upon the core of the mandrel or chuck and then clamped in an inner condition. This assembly is then mounted in a lathe and one or more grooves 48 are formed in the exterior surface of the held leaves. After forming the desired or required number of grooves in the exterior surfaces, the clamping means is removed and a tension member such as a garter spring or a rubber O-ring 50 is placed in this formed groove to draw the leaf members to their inner condition. It is to be noted that the leaf member 40 has a smooth underside so as to not chafe the rubber, tubular member 34. A smooth edge 52 is formed at the tongue portion and a like smooth corner 54 is formed at the undercut groove end.

USE AND OPERATION OF THE EXPANDING SLEEVE ASSEMBLY

The expanding sleeve of this invention uses interconnecting segments of a like configuration. Preferably these segments are made as fractional increments of pi as fully described in U.S. Pat. No. 3,937,412. By adding or subtracting a leaf member, very close steps in diametrical increments are available. As is explained in the above noted patent, these segments are preferably of one-sixteenth of pi times 1 inch, one-eighth of pi times one inch, one-quarter of pi times one inch or, for larger sizes, one-half pi times one inch. This permits shaft diameters to be as small as one-half inch minimum with eight leaf segments and to be greater than 6 or 8 inches in diameter with one-half times pi segments. It is, of course, not necessary that the segments be a precise fraction of pi since other pitch lengths may be utilized. However, this utilization of pi times one inch divided by one-half, one-quarter, one-eighth or one-sixteenth times one inch provides an easy mandrel size change.

From a practical standpoint, it is assumed that the leaf member 40 is an extrusion of metal or semirigid plastic and as such may conventionally have a longitudinal, outwardly facing profile in which serrations give a bite or engaging action to the core. One edge of the leaf has an extending tongue portion 44 formed with an outer edge having a circular cross sectional portion 46. The other edge is made with a groove portion 41 which has a reduced outer entranceway 42 which retains the enlarged portion of the tongue. The enlarged inner portion of the groove is formed with a sufficient clearance so that the tongue will have a twenty- to thirty-thousandths of an inch or more play when mounted in the groove portion 41.

In order to urge the serially connected segments 40 to their minimum diameter garter springs or rubber O-rings 50 are employed. As above mentioned, after the leaf members have been arranged in a closed circular manner outer circumferential grooves 48 are formed. The number of grooves are dependent upon the diameter and length of the expanding mandrel or chuck. One or more pins or screws 58 are contemplated to be mounted in one or more of the leaf members and extend into the core or body 30. Whether a pin or a screw is used is strictly a matter of selection. The outer portion of the pin or screw is made slidable on the leaf so that the leaf can be moved outwardly by the expanding rubber tube 34. No fixed or retaining guide for the leaf is required. A full outer expansion of the leaf is achieved with generally any tube whether helically wound or longitudinally arranged and the force applied results in a sleeve that is more-or-less self-centering. The number of pins 58 that are to be used is merely a matter of selection and the force anticipated and required by the chuck and by the leaf members carried thereon. Usually there are three or four pins which are mounted so as to distribute the torque to the chuck core or body in a fairly even manner. The closure of the ends of the rubber tubing member 34 may be and is contemplated to be in the manner as shown in U.S. Pat. No. 3,917,187, above-identified.

The simplicity and improvement of the present invention provides the advantage of interlocking leaf segments as in U.S. Pat. No. 3,937,412 with the omission of the rubber tension members used to draw the leaf members of that patent together. Many times the mounting of the final rubber tension member in the longer mandrel is a problem and the use of a garter spring has proved to be simpler to repair, to change and to make the final assembly. There has been contemplated the use of a rubber member as in U.S. Pat. No. 3,937,412 with all except two leaf segments which are interconnected. Since other tension means for the remaining two leaf members do not provide a smooth outwardly expansion other and additional spring tension is required and this is not a preferred arrangement. Although such a concept may be used it is preferred that the simple arrangement of like extrusion members, seen in FIG. 7, be used throughout and that the garter spring or O-rings 50 in the circumferential groove 48 be used in this improvement.

SCREW RETAINER OF FIG. 8

Figure 8:
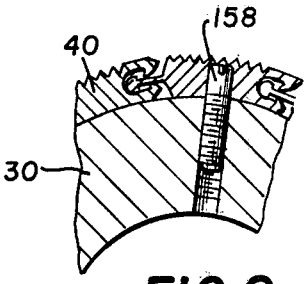
FIG. 8 represents a sectional view showing the arrangement of segments as retained by a core and screw pin.

Referring next to FIG. 8 there is shown an arrangement wherein a screw 158 is used rather than the pin 58 of FIG. 6. The body 30 is threaded to receive screws 158 which have their inner portions threaded and with a smooth outer portion where the screw is in driving contact with the leaf members 40 carried by and on the body. These screws may have a screwdriver slot end for mounting and when mounted the outer end of this screw is below the surface of the leaf member in the retracted condition.

MANDREL ASSEMBLY OF FIGS. 9 AND 10

Figure 9:
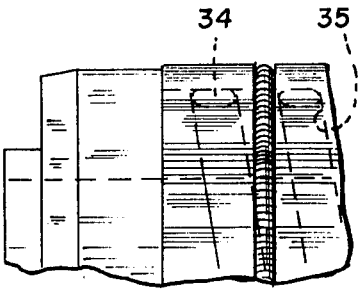
FIG. 9 represents a side view partly fragmentary of the assembly of leaf segments retained by a garter spring while they are expanded by a tube carried in a helical groove.
Figure 10:
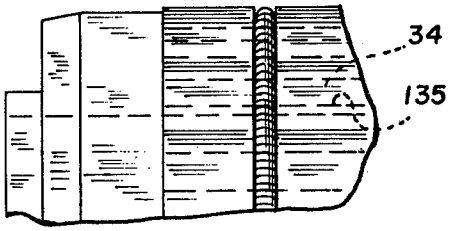
FIG. 10 represents a side view partly fragmentary of the assembly of leaf segments retained by a garter spring while they are expanded by a tube or tubes arranged in a longitudinal pattern.

Referring next to the drawing and the mandrel assemblies of FIGS. 9 and 10, it is to be noted that FIG. 9 shows a mandrel in which the expanding tube 34 is carried in a spiral groove 35. In FIG. 10 the mandrel employs longitudinal grooves 135 which retain longitudinally arranged tube or tubes 34. No matter the arrangement of the grooves and expanding tubing a chafing means is desirably employed to reduce and where possible eliminate the wear and abrasion of the tube 34 as it engages the leaf members 40.

CHAFING STRIP ARRANGED ACCORDING TO FIG. 11

Figure 11:
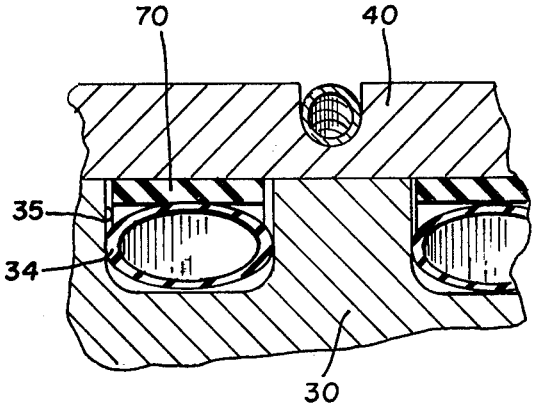
FIG. 11 represents in an enlarged scale a fragmentary side view of the assembly of FIG. 9 with the leaf segments removed and a rubber chafing strip mounted in the spiral groove and between the outer diameter of the tube and the leaf segments.

Referring next to the enlarged fragmentary view of FIG. 11 there is shown a body 30 having a spiral groove 35 in which an expanding tube 34 is mounted. A chafing strip 70 is also mounted in this groove and exterior of the tube 34. This strip 70 may be of rubber cut to a width which is about the width of the groove 35 and may have a thickness of one-sixteenth to one-quarter of an inch. This strip prevents the tube 34 from engaging the leaf members 40 as it is moved in and out during operation. This strip 70 remains in the groove 35 since the expansion of the tube 34 as retained by the leaf member 40 is less than the distance occupied by the chafing strip.

CHAFING STRIP ACCORDING TO FIG. 12

Figure 12:
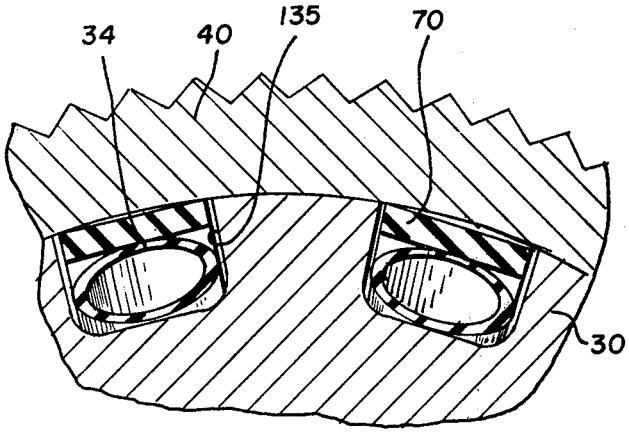
FIG. 12 represents in an enlarged scale a fragmentary end view of the assembly of FIG. 10 and with the leaf segments removed and a rubber chafing strip mounted in each longitudinal groove and between the outer surface of the tube and the leaf segments.

Referring next to FIG. 12, it is to be noted that the chafing strip 70 may also be used if and when longitudinal grooves 135 are employed to carry the tube or tubes 34. As in FIG. 11 when the chafing strip 70 is used the expansion of the tube 34 does not displace the strip 70 from the groove 135 as the leaf members 40 move outwardly less than the thickness of the strip 70.

CHAFING STRIP OF FIG. 13

Figure 13:
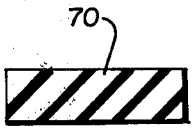
FIG. 13 represents a sectional view of the chafing strip as depicted in FIGS. 11 and 12.

In FIG. 13 is depicted the cross section of the chafing strip 70 which is conventionally cut from a larger sheet. This strip may also be a rubber extrusion. The thickness is selected to accommodate the width of the groove and the amount of expansion allowed by the interlocked leaf members 40.

CHAFING STRIP OF FIG. 14

Figure 14:
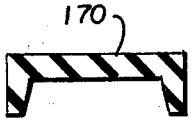
FIG. 14 represents a sectional view of an alternate chafing strip in which the cross-sectional configuration is channel shaped.

Referring finally to FIG. 14, there is depicted an alternate chafing strip 170 which is shown as a channel configuration. The inside of this strip may be contoured to seat on the oval tubing 34. The outer width is made to suit the width of the groove and the thickness is selected to suit the maximum expansion of the outer sleeve assembly. No matter the configuration of the chafing strip a resilience to permit expansion and contraction in accordance with the expansion of the tube 34 is required and desired. Retention in the groove of this strip during this expansion and contraction is also necessary and desired. Whether the strip 70 of FIG. 13 or the channel-shaped extrusion 170 of FIG. 14 is used, the thickness is such that when the tube 34 is expanded the linked leaf members 40 limit the outward movement of the chafing strip. No matter the configuration, the chafing strip is sufficiently thick that in the expanded condition at least one-sixteenth of an inch of strip remains in the groove 35 or 135. Rubber or rubber-like material has proved to be the desired material for the chafing strips which have reduced or eliminated chafing and/or abrasion.

The arrangement of the garter springs in the circumferential grooves lend themselves to many arrangements and it is only necessary that the outer leaf member assembly be urged to its minimum diameter against the bias tension of the expanding tube to move the leaf members outwardly to engage the core of the spool to be driven or carried by the mandrel or chuck. Leaf members having both serrations and smooth surfaces may be and are commercially used. Modification of the serrations or tooth, when used, is made to accommodate particular spool or coil requirements.

In both FIGS. 6 and 8, headless screws or pins 58 and 158 are shown and described. On many shaft assemblies it has been found desirable to use flat head screws and spacer washers instead of the headless screw or pin. This arrangement fixes the leaf segment 40 and may be applied to one, two or three segments 40 depending on the size of the shaft. This arrangement also provides two benefits, ie. it provides a self-centering of the leaf segments on and with the body and also reduces, if not substantially eliminates, an excessive sliding wear of the pin in the hole in the leaf as it slides on pin 58 or 158. The flat head screw and spacer washer is used to bring the leaf member's outer surface to a nominal diameter of the core to be carried, thus centering the core on the shaft. This fixing of the leaf by a screw and spacer washer is applied to only a minimal number of leaf members 40. The outwardly expansion of the serially connected leaf members 40 is still limited by the tongue end 46 in the groove 41. The maximum outwardly expansion is still maintained by the number of leaf members in the assembly of the expansion shaft.

Terms such as "left", "right", "bottom", "top", "front", "back", "in", "out" and the like are applicable to the embodiments shown and described in conjunction with the drawings. These terms are merely for the purpose of description and do not necessarily apply to the position in which the leaf members and associated circumferential spring tension members may be constructed or used.

While a particular embodiment of this expanding sleeve of the mandrel or chuck has been shown and described it is to be understood the invention is not limited thereto and protection is sought to the broadest extent the prior art allows.

What is claimed is:

1. A circumferential sleeve assembly which is mounted in and on an expanding mandrel, spool shaft and the like and which provides a core support for said mandrel, and in which the expansion means for the sleeve assembly is at least one resilient tube carried by a body member and in which there is provided means for selectively feeding and releasing air, fluid and the like from said resilient tube, said mandrel and sleeve assembly including: (a) a body member; (b) at least one resilient tube carried in a guide groove formed in said body member; (c) end member means carried by said body member, said end member means providing confining limits for the tubing and also establishing the overall length of the body member; (d) a circumferential sleeve assembly carried by the body member and between the limits established by the confining end members, this sleeve assembly further including; (e) a multiplicity of serially connected leaf members, each leaf member having one longitudinal edge formed as a tongue whose outer portion is enlarged to provide a greater thickness than the portion connecting the tongue to the leaf member, and with the other longitudinal edge of the leaf member formed with a retaining groove whose outer entryway is narrower than the enlarged outer portion of the tongue, said entryway freely passing said connecting portion of the tongue, the resulting assembly of a tongue of one leaf member into a retaining groove of an adjacent leaf member providing a retention of the tongue in the groove with the capturing of the enlarged portion preventing dislodgement while providing a determined amount of play, this assembled tongue in a groove permitting limited movement of adjacent leaf members toward and away from each other, each leaf member having a smooth inner surface and with the inner edge portions blunted and smoothed sufficiently to provide and present a non-chafing surface to the expanding resilient tube; (f) a plurality of circumferential grooves formed in the periphery of the assembled sleeve assembly, said grooves being of a determined depth and width, and (g) a plurality of biased tension members each carried in one of said grooves with the groove depth and width sufficient to receive a said tension member and in the non-expanded condition of the sleeve assembly the tension member is below the outer peripheral surface of the sleeve assembly, said tension member when in mounted condition being slightly stretched so as to draw toward each other the leaf members to which they are secured, the connected leaf members of a sleeve assembly being positioned over the resilient tube so that when said tube is expanded the leaf members are urged outwardly by the expansion of the tube and with an outward diametrical limit being established by the play of the tongue in the groove, and when the pressure in the tube is decreased the stretched tension members draw the leaf members toward and to the body member.

2. A circumferential sleeve assembly as in claim 1 in which the tongue formed along the longitudinal edge of the leaf member has the enlarged portion formed as a somewhat circular cross section, and in which the retaining groove in and along the opposite longitudinal edge is formed with an enlarged and larger recess having a somewhat circular cross section which is similar and compatible with the enlarged portion of the tongue.

3. A circumferential sleeve assembly as in claim 1 in which at least a portion of the exterior surface of the leaf member is formed with serrations providing tooth-like projections adapted to engage the inside surface of a core mounted thereon, this engagement of the tooth-like projections occurring as and when the expanding of the sleeve assembly is made.

4. A circumferential sleeve assembly as in claim 1 in which grooves are formed in the body member, said grooves providing retaining and positioning means for that portion of the resilient tube which is inflated to cause the leaf members to be moved outwardly.

5. A circumferential sleeve assembly as in claim 4 in which the torque to and from the leaf members is derived from operations on a workpiece carried on said mandrel, said torque being transmitted from and transferred to the body member by pins which pass through snugly fitting holes in the leaf members and into snugly fitting holes in the body member, the pins being placed so as to avoid engagement with and damage to the resilient tube.

6. A circumferential sleeve assembly as in claim 4 in which the torque to and from the leaf member is derived from operations on a workpiece carried on said mandrel, this torque being transmitted from and transferred to the body member by screws which pass through snugly fitting holes in the leaf member and into threaded holes formed in the body member, the screws being placed so as to avoid engagement with and damage to the resilient tube.

7. A circumferential sleeve assembly as in claim 1 in which the effective width of the assembled leaf member is one-sixteenth pi times one inch, this leaf member also having a curve adapted for a core whose inner diameter is generally one inch or less in diameter.

8. A circumferential sleeve assembly as in claim 1 in which the effective width of the assembled leaf member is one-eighth pi times 1 inch, this leaf member also having a curve adapted for a core whose inner diameter is generally from one to three inches in diameter.

9. A circumferential sleeve assembly as in claim 1 in which the effective width of the assembled leaf member is one-quarter pi times 1 inch, this leaf member also having a curve adapted for a core whose inner diameter is generally greater than three inches.

10. A circumferential sleeve assembly as in claim 1 in which the biased tension members are garter springs.

11. A circumferential sleeve assembly as in claim 1 in which the biased tension members are rubber-like O-rings.

12. A circumferential sleeve assembly as in claim 1 in which a rubber-like chafing strip is mounted in the guide groove formed in the body, this chafing strip interposed between the resilient tube and circumferential sleeve assembly to reduce any abrasive action of the sleeve members on the tube during expansion and contraction of the tube.

13. A circumferential sleeve assembly as in claim 12 in which the chafing strip is a rectangular strip whose width is made to slidably mount in the guide groove.

14. A circumferential sleeve assembly as in claim 12 in which the chafing strip is a channel cross-sectional configuration and having a width made to slidably mount in the guide groove.

15. A circumferential sleeve assembly as in claim 12 in which the chafing strip is sufficiently thick so that in an expanded condition the linked leaf members restrain the chafing strip so that at least one-sixteenth of an inch of strip remains in the guide groove.

* * * * *